US008454130B2

(12) United States Patent
Iinuma

(10) Patent No.: US 8,454,130 B2
(45) Date of Patent: Jun. 4, 2013

(54) LIQUID EJECTION HEAD AND METHOD OF PRODUCING LIQUID EJECTION HEAD

(75) Inventor: Keisuke Iinuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/342,789

(22) Filed: Jan. 3, 2012

(65) Prior Publication Data

US 2012/0176451 A1 Jul. 12, 2012

(30) Foreign Application Priority Data

Jan. 7, 2011 (JP) ..... 2011-002166

(51) Int. Cl.
*B41J 2002/14491* (2006.01)
*B41J 2/14072* (2006.01)
*B41J 2/1623* (2006.01)

(52) U.S. Cl.
USPC ..... 347/50

(58) Field of Classification Search
USPC ..... 347/50
See application file for complete search history.

(56) References Cited

U.S. PATENT DOCUMENTS 5,297,331 A * 3/1994 Childers ..... 29/611
5,442,386 A * 8/1995 Childers et al. ..... 347/50
5,450,113 A * 9/1995 Childers et al. ..... 347/87
5,519,421 A * 5/1996 Barr et al. ..... 347/47
5,852,460 A * 12/1998 Schaeffer et al. ..... 347/87
6,084,612 A * 7/2000 Suzuki et al. ..... 347/50
6,267,472 B1 * 7/2001 Maher et al. ..... 347/65
6,877,839 B2 * 4/2005 Kawamura et al. ..... 347/50
7,240,991 B2 * 7/2007 Timm et al. ..... 347/50
7,547,094 B2 * 6/2009 Kawamura et al. ..... 347/50
7,651,196 B2 * 1/2010 Timm et al. ..... 347/50
7,673,971 B2 * 3/2010 Timm et al. ..... 347/50
2005/0073552 A1 * 4/2005 Smoot et al. ..... 347/50
2008/0158298 A1 * 7/2008 Serbicki et al. ..... 347/50

* cited by examiner

*Primary Examiner* — Matthew Luu
*Assistant Examiner* — Alexander D Shenderov
(74) *Attorney, Agent, or Firm* — Canon U.S.A., Inc., IP Division

(57) ABSTRACT

A method of producing a liquid ejection head includes preparing an element substrate including energy generating elements for generating energy and connecting terminals electrically connected to the energy generating elements, an electrical wiring member including lead wires electrically connected to the connecting terminals, and a support member supporting the element substrate and has a recess for accommodating the element substrate and a protrusion protruding inward from an inner surface of the recess; providing adhesive on a bottom surface of the recess, positioning the element substrate in the recess and pressing the adhesive to introduce a portion of the adhesive into a space between the protrusion and the element substrate, and sealing a connected portion of the connecting terminals and the lead wires with a sealing material, the sealing material being prevented from flowing by a portion of the adhesive filling the space between the protrusion and the element substrate.

10 Claims, 7 Drawing Sheets

LIQUID EJECTION HEAD AND METHOD OF PRODUCING LIQUID EJECTION HEAD

BACKGROUND OF THE INVENTION

1. Field of the Invention

The present invention relates to a liquid ejection head and a method of producing a liquid ejection head that ejects liquid.

2. Description of the Related Art

Known liquid ejection heads include an element substrate that has a group of ejection ports through which liquid, such as ink, is ejected and energy generating elements corresponding to the ejection ports. Such a liquid ejection head further includes a contact portion through which electric signals and power for driving the energy generating elements from an ink jet recording apparatus body are received. Usually, the contact portion is connected to the element substrate by a flexible electrical wiring member.

When a support member, which is a part of a housing of the liquid ejection head, is connected to the element substrate, adhesive is applied to the support member, and then the element substrate is positioned with respect to the support member. The electrical wiring member and the element substrate are electrically connected to each other by an inner lead exposed from the electrical wiring member and connecting terminals provided on the element substrate. Then, the electrically connected portion is covered by a sealing material for protection. Because this sealing material needs to quickly fill small spaces, such as gaps in the electrically connected portion, a relatively low-viscous sealing material is often used.

Such a sealing material is provided in order to avoid contact with a side surface of the element substrate because expansion or contraction of the sealing material due to, for example, a change in environment exerts an external force on the element substrate. Recently, element substrates have been reduced in size in response to the demand for compact liquid ejection heads. Therefore, if a sealing material exerts an external force on such an element substrate, the element substrate may be deformed.

U.S. Pat. No. 7,240,991 discloses a method in which a wall made of another adhesive is provided to prevent a sealing material from flowing in side surfaces of an element substrate that are not provided with connecting terminals. In this method, after a wall made of another adhesive is provided between the connecting terminals of the element substrate and the side surfaces of the element substrate that are not provided with the connecting terminals, a sealing material is injected to cover the electrically connected portion, thereby preventing spreading of the sealing material.

However, because the configuration disclosed in U.S. Pat. No. 7,240,991 requires another adhesive to form a wall for preventing inflow of the sealing material, the component count increases. Furthermore, because this configuration requires steps of applying and curing this adhesive, the production cost of liquid ejection heads increases.

SUMMARY OF THE INVENTION

According to one aspect of the present invention, a method of producing a liquid ejection head includes preparing an element substrate including energy generating elements that generate energy for ejecting liquid and connecting terminals that are electrically connected to the energy generating elements, an electrical wiring member including lead wires electrically connected to the connecting terminals, and a support member configured to support the element substrate, the support member having a recess for accommodating the element substrate and a protrusion protruding inward from an inner surface of the recess, providing adhesive on a bottom surface of the recess, positioning the element substrate in the recess and pressing the adhesive to introduce a portion of the adhesive into a space between the protrusion and the element substrate, and sealing a connected portion of the connecting terminals and the lead wires with a sealing material, the sealing material being prevented from flowing by a portion of the adhesive filling the space between the protrusion and the element substrate.

Further features of the present invention will become apparent from the following description of exemplary embodiments with reference to the attached drawings.

DESCRIPTION OF THE EMBODIMENTS

Figure 1A:
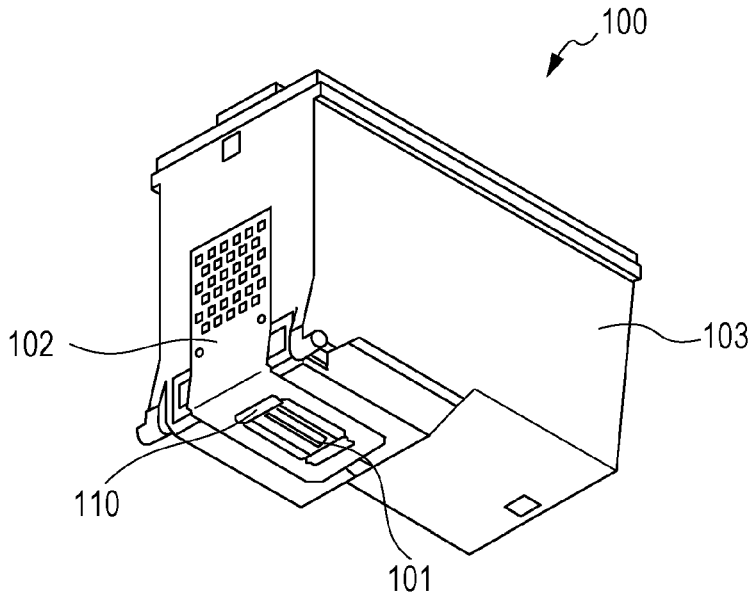
FIGS. 1A and 1B are perspective views of a liquid ejection head according to an embodiment of the present invention.
Figure 1B:
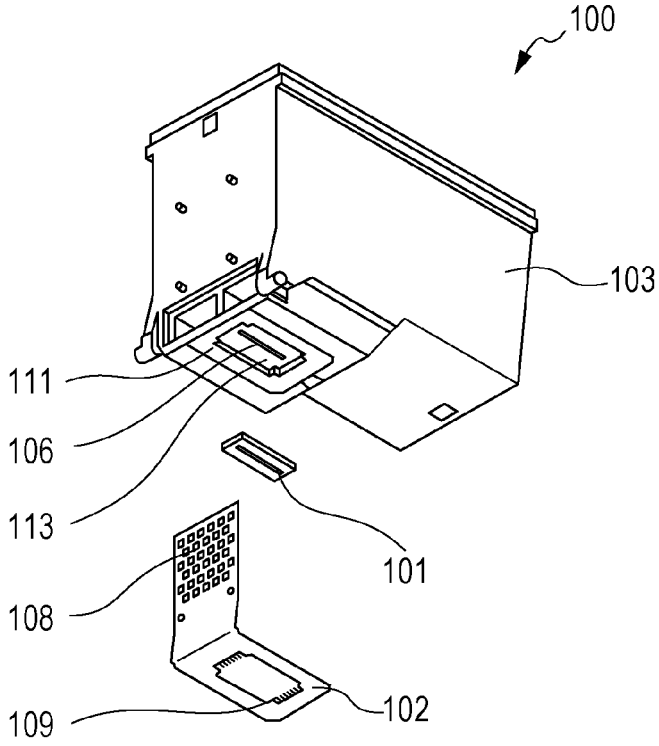
Figure 2A:
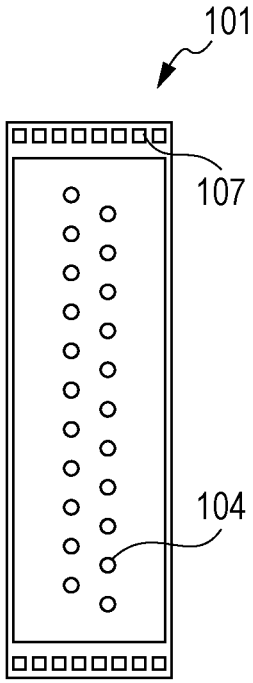
FIGS. 2A and 2B are front views of a recording element substrate constituting the liquid ejection head according to an embodiment of the present invention.
Figure 2B:
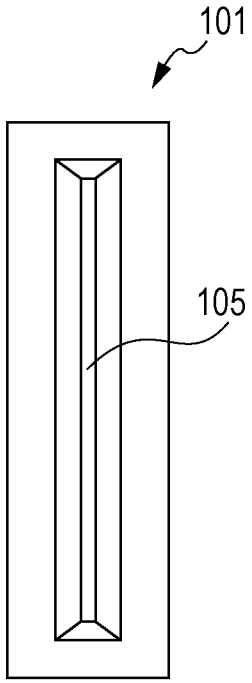

Referring to the drawings, an exemplary embodiment of the present invention will now be described. FIGS. 1A, 1B, 2A, and 2B show the overall configuration of a liquid ejection head 100 according to the exemplary embodiment of the present invention. FIG. 1A is a perspective view of the liquid ejection head 100, and FIG. 1B is an exploded perspective view showing the respective parts of the liquid ejection head 100 shown in FIG. 1A in an exploded manner. FIG. 2A is a top view of an element substrate 101, which constitutes the liquid ejection head 100, showing a surface provided with ejection ports 104, and FIG. 2B is a bottom view of the element substrate 101, showing a back surface provided with an ink supply port 105.

As shown in FIG. 1A, the liquid ejection head 100 includes the element substrate 101, an electrical wiring member 102, and an ink container 103. The ink container 103 contains ink injected therein. Ink is guided to the element substrate 101 through an ink-supply flow path 106 communicating with the ink container 103 and is ejected from the ejection ports 104 provided in the element substrate 101. In the present embodiment, the liquid ejection head 100 and the ink container 103 are integrated as a single component. However, in another embodiment, the configuration is such that the ink container 103 is removably attached to the liquid ejection head 100.

Figure 4:
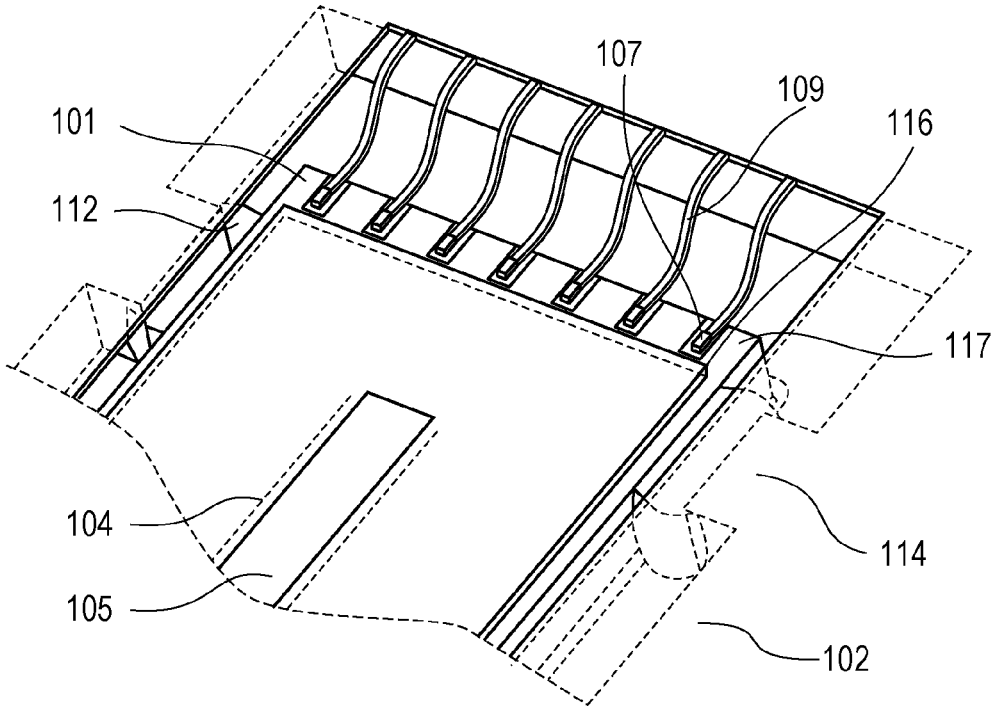
FIG. 4 is a perspective view of a liquid ejection head according to an embodiment of the present invention.

As shown in FIG. 4, a substrate 117 constituting the element substrate 101 is provided with the ink supply port 105 having the shape of an elongated groove-like through-hole and communicating with the ink-supply flow path 106. Electrothermal transducers (not shown), serving as energy generating elements for generating energy used to eject ink, are provided on both sides of the ink supply port 105. Furthermore, wiring lines through which power and electric signals are supplied to the electrothermal transducers are formed on the substrate 117. In addition, a plurality of connecting terminals 107 that receive electric signals and power from the electrical wiring member 102 are arranged at one end and the other end of the substrate 117 of the element substrate 101. Furthermore, a nozzle plate 116 disposed on the substrate 117 has the ejection ports 104 provided, which correspond to the electrothermal transducers. Flow paths (not shown), through which the ejection ports 104 communicate with the ink supply port 105, are formed between the nozzle plate 116 and the substrate 117.

The electrical wiring member 102 is a flexible wiring member that transmits electric signals and power for ejecting ink from the recording apparatus body to the element substrate 101. The electrical wiring member 102 has a contact portion 108, an electrical wiring line (not shown) located between resin films, and inner leads 109, which are lead wires exposed from ends of the resin film. One examples of the flexible electrical wiring member 102 is, but not limited to, a tape automated bonding (TAB) tape. When the liquid ejection head 100 is attached to the recording apparatus body, the contact portion 108 including a plurality of contact pads comes into contact with connector pins (not shown) of the recording apparatus body and is electrically connected thereto. The electrical wiring line formed on the electrical wiring member 102 connects the contact portion 108 and the inner leads 109. The inner leads 109 are electrically connected to the connecting terminals 107 provided on the edges of the element substrate 101 by bonding. After the inner leads 109 and the connecting terminals 107 of the element substrate 101 are connected, a resin sealing material 110 is applied thereto to protect the connecting terminals from liquid, such as ink.

When the support member 111, which is a part of the housing of the liquid ejection head 100, is connected to the element substrate 101, adhesive 112 is applied to the support member 111, and then the element substrate 101 is positioned with respect to the support member 111. Furthermore, the electrical wiring member 102 is securely bonded to the support member 111 with adhesive different from the adhesive used to bond the element substrate 101.

The support member 111 is formed by resin molding, and a resin material, modified polyphenylene ether, used in the present embodiment contains 35 percent glass filler by mass to increase the rigidity. This support member 111 has such a shape that a portion on which the element substrate 101 is disposed is recessed (a recess 113) from the periphery to which the electrical wiring member 102 is securely bonded. The reason for this is to make the inner leads 109 of the electrical wiring member 102 substantially flush with the connecting terminals 107 of the element substrate 101, thereby increasing the reliability of the electrically connected portions between them (see FIGS. 5A and 5B).

Figure 3:
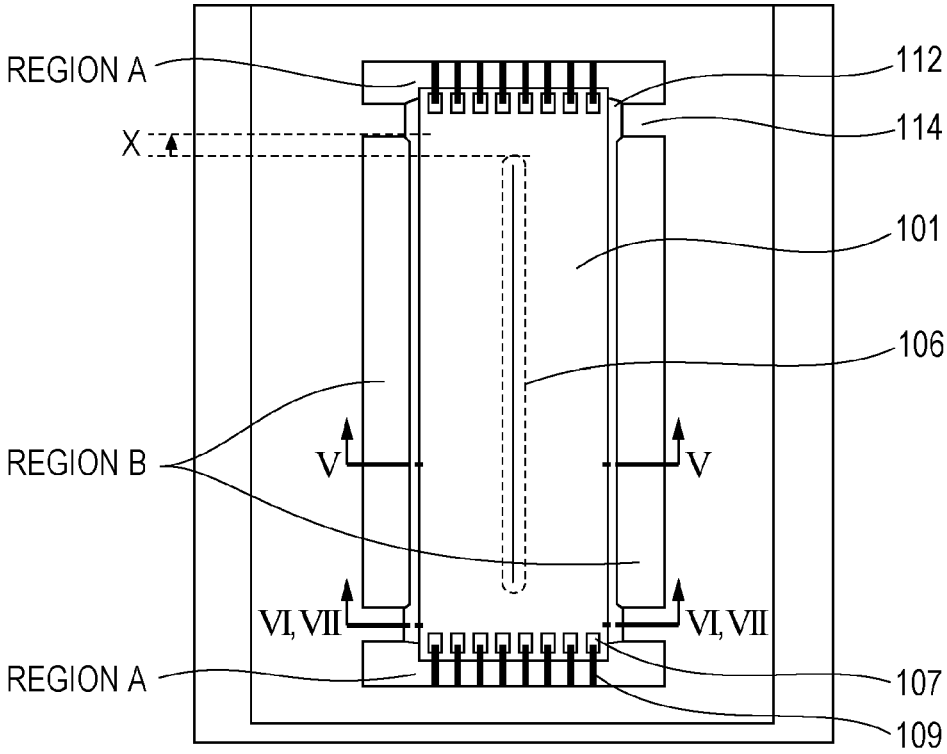
FIG. 3 is a front view of a surface of the recording element substrate according to an embodiment of the present invention.

FIGS. 3 to 6 are schematic diagrams of the liquid ejection head 100 according to the present embodiment. FIG. 3 shows the liquid ejection head 100 as viewed from the element substrate 101 side, and FIG. 4 is a perspective view showing a portion around the connecting terminals connecting the element substrate 101 and the electrical wiring member 102.

As shown in FIGS. 3 and 4, the support member 111 has protrusions protruding inward from the inner surfaces of the recess 113. More specifically, protrusions 114 protruding from the side walls and bottom surface of the recess 113 are provided. As will be described below, the adhesive 112 fills a region between the protrusions 114 and the element substrate 101. Regions A and regions B, shown in FIG. 3, are divided by the protrusions 114 and the adhesive 112. In the present embodiment, the protrusions 114 are integrally formed with the support member 111 by, for example, injection molding, when the support member 111 is molded. Although the protrusions 114 in this embodiment have a protruding shape as shown in FIG. 4, the protrusions 114 may have any shape as long as they can partially reduce the distance between the side surfaces of the element substrate 101 and the side surfaces of the recess 113 in the support member 111.

As shown in FIG. 2, in the present embodiment, the connecting terminals 107 are provided along short sides of the element substrate 101, i.e., at two positions on both ends of the element substrate 101 in the longitudinal direction. In this configuration, as shown in FIGS. 3 and 4, the protrusions 114 are provided on the long sides of the element substrate 101, along which no connecting terminals are provided, at positions near the short sides, along which the connecting terminals are provided. In the present embodiment, four protrusions 114, in total, are provided so as to form pairs. Note that, however, if only one connecting terminal 107 is provided, two protrusions 114 are provided at positions close to the connecting terminals 107. Furthermore, as shown in FIG. 3, the protrusions 114 are provided at positions at predetermined distance X away from the ink supply port 105 provided in the element substrate 101 toward the ends of the element substrate 101. The reason for this is that, if the protrusions 114 are provided near the supply port 105, the sealing material advances near the supply port 105, increasing the influence on the portion provided with the ink supply port 105 in the element substrate 101. Although distance X is desirably several tens μm, distance X may be 0. The protrusions 114 desirably have such a length, in the direction in which the ejection ports 104 are arranged, that they do not overlap the region where the supply port 105 is provided.

As has been described, in the present embodiment, the connecting terminals 107 are provided at one end and the other end of the element substrate 101, and the protrusions 114 are provided on the side surfaces of the element substrate 101 in a direction perpendicular to the direction connecting the one end and the other end. More specifically, the protrusions 114 are formed on the side surfaces of the recess 113, at the one end and the other end of the element substrate 101. With this configuration, the area over which the sealing material is spread can be limited without increasing the length of the protrusions 114. However, the present invention is not limited to this configuration, and the protrusions 114 may be provided at positions corresponding to the corners of the element substrate 101. Furthermore, the protrusions 114 may be provided at positions corresponding to the sides of the element substrate 101 provided with the connecting terminals 107. In this case, by providing the protrusions 114 at positions corresponding to both ends of the plurality of connecting terminals 107, the sealing material 110 can be prevented from being spread over a wide area.

Figure 5A:
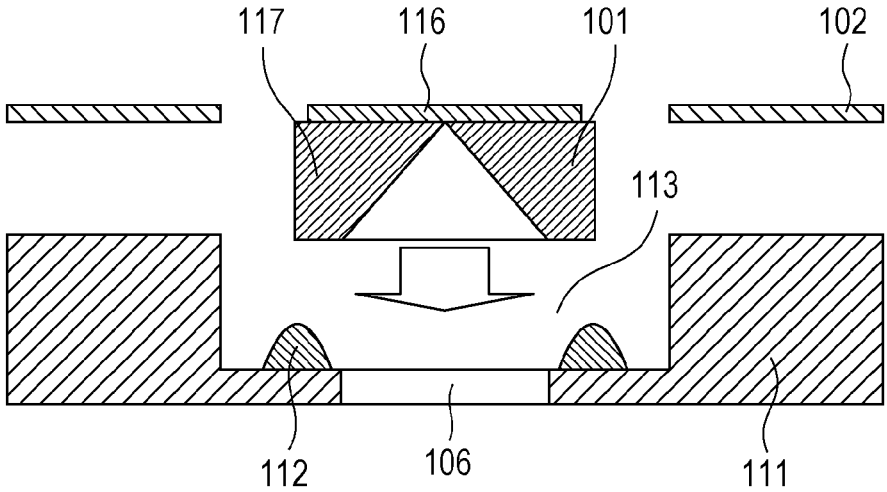
FIGS. 5A and 5B are cross-sectional views of a liquid ejection head according to an embodiment of the present invention, taken along line V-V in FIG. 3.
Figure 5B:
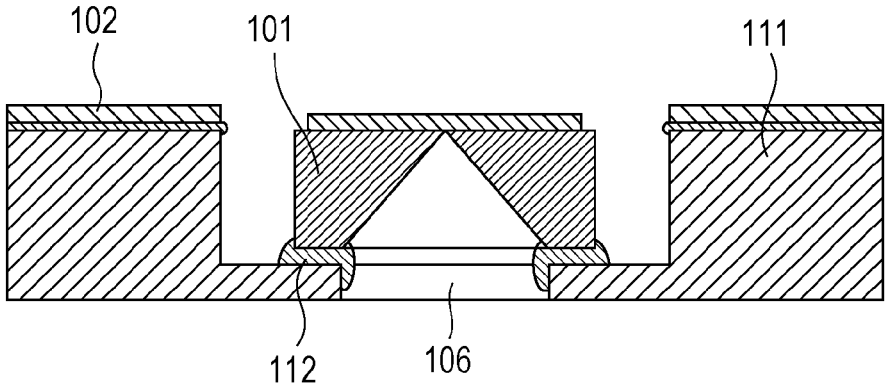
Figure 6A:
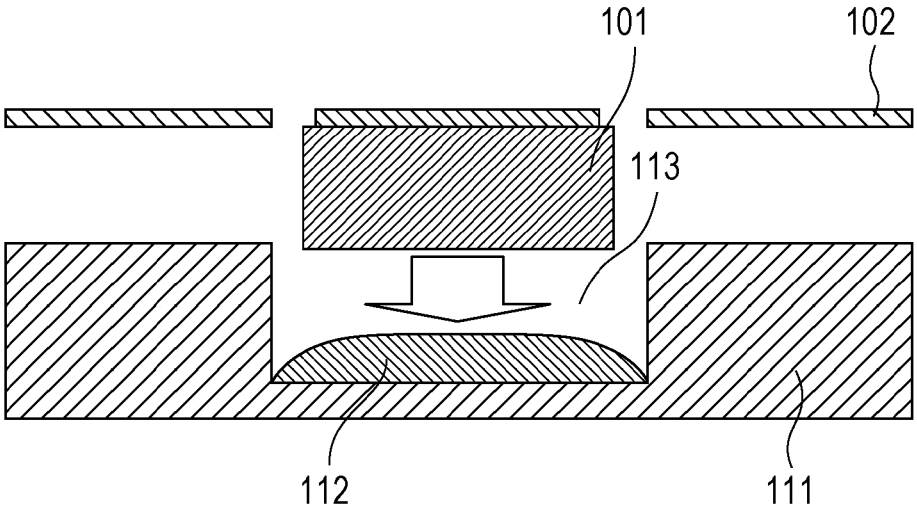
FIGS. 6A and 6B are cross-sectional views of a liquid ejection head according to an embodiment of the present invention, taken along line VI-VI in FIG. 3.
Figure 6B:
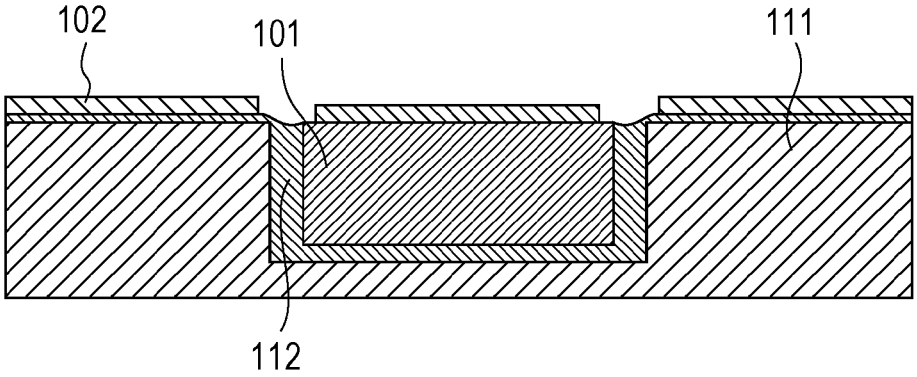

Next, referring to FIGS. 5A, 5B, 6A, and 6B, a process of securely bonding the element substrate 101 to the support member 111 will be described. FIGS. 5A and 5B are cross-sectional views of the liquid ejection head 100, taken along line V-V in FIG. 3, showing the process of securely bonding the element substrate 101 to the support member 111. FIGS. 6A and 6B are cross-sectional views of the liquid ejection head 100, taken along line VI-VI in FIG. 3, showing the process of securely bonding the element substrate 101 to the support member 111, similarly to FIG. 5.

First, as shown in FIGS. 5A and 6A, the adhesive 112 is applied to a region in which the element substrate 101 is disposed, i.e., the bottom surface of the recess 113 in the support member 111. At this time, adhesive 112 of a heat-curing type is used. Desirably, adhesive 112 that is temporarily cured by UV rays and then cured by heating the element substrate 101 is used, because the positioning accuracy has to be maintained until the adhesive 112 is completely cured. Furthermore, more adhesive 112 is applied to regions near the protrusions 114 than the other regions.

In the present embodiment, the element substrate 101 and the inner leads 109 of the electrical wiring member 102 are electrically connected before the element substrate 101 is disposed on the support member 111. However, the present invention is not limited thereto, and the element substrate 101 and the inner leads 109 of the electrical wiring member 102 may be electrically connected after the element substrate 101 and the electrical wiring member 102 are bonded to the support member 111.

Next, as shown in FIGS. 5B and 6B, the element substrate 101 is brought into the recess 113 in the support member 111, to which the adhesive 112 is applied, using a suction-type or heating-type tool, and the element substrate 101 is positioned and disposed therein. When the element substrate 101 is placed in the recess 113, the adhesive 112 pressed by the element substrate 101 is pushed out into a region between the element substrate 101 and the protrusions 114 of the support member 111. As shown in FIG. 6B, because the distance between the protrusions 114 and the side walls of the element substrate 101 is smaller than the other regions, the adhesive 112 is likely to be introduced to that region. Furthermore, because the distance is small, the gap can be filled with a small amount of the adhesive 112. Furthermore, because a force that pulls the adhesive 112 toward the top surface of the element substrate 101 is generated by the capillary force acting on this region, the adhesive 112 is quickly introduced. The height of the adhesive 112 introduced to this region is larger than, at least, half the height of the element substrate 101, and, in order to more reliably prevent inflow of the sealing material, the adhesive 112 is introduced to the same height as the element substrate 101.

Next, an epoxy resin sealing material 110 is applied to the connecting portions between the inner leads 109 of the electrical wiring member 102 and the connecting terminals 107 of the element substrate 101 to protect the connecting portions from liquid, such as ink, and an external force. The sealing material 110 covering the connecting portions is trapped in spaces (regions A in FIG. 3) enclosed by the side walls of the element substrate 101, the inner walls of the recess 113 in the support member 111, the adhesive 112, and the side walls of the protrusions 114. In this embodiment, regions A and regions B (regions between the support member 111 and the side walls of the long sides of the element substrate 101) are divided by the protrusions 114 and the adhesive 112, the sealing material 110 applied to the regions A can be prevented from flowing in regions B. Thus, an external force due to expansion and contraction of the sealing material 110 can be prevented from being exerted on the element substrate 101. Although a certain level of external force is exerted on the element substrate 101 due to expansion and contraction of the adhesive between the protrusions 114 and the element substrate 101, because such an external force is exerted locally, the influence is insignificant. Furthermore, because the protrusions 114 are provided in the regions between the supply port 105 and the ends of the element substrate 101, the influence on the flow path and the ejection ports is further reduced.

In addition, by providing a plurality of grooves in surfaces of the protrusions 114 facing the element substrate 101, the adhesive is encouraged to flow upward. Because the capillary force is increased by shaping the grooves such that the width thereof is reduced from the bottom surface toward the top of the recess 113, the adhesive is encouraged to flow upward.

Figure 7:
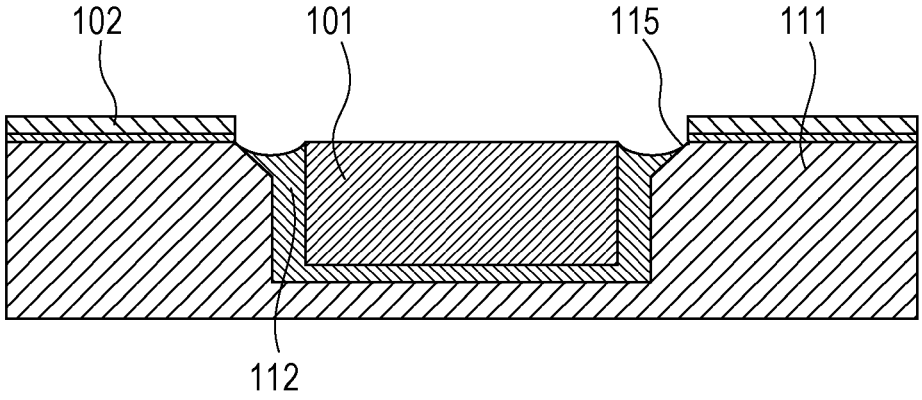
FIG. 7 is a cross-sectional view of a liquid ejection head according to an embodiment of the present invention.

In order to divide regions A from regions B, the adhesive at the protrusions 114 is introduced to the same height as the element substrate 101. However, it is important to control the adhesive such that it does not flow beyond the element substrate 101 and flow over the ejection port surface of the element substrate 101. FIG. 7 is a cross-sectional view of a portion provided with the protrusions 114. As shown in FIG. 7, by employing a tapered structure, i.e., by providing inclined portions 115 near the upper edges of the inner surfaces of the recess 113, the distance between the side walls of the element substrate 101 and the inner surfaces of the recess 113 is increased from the bottom surface toward the top surface of the recess 113. With this structure, the speed of the adhesive flowing upward decreases at upper portions, and the control of the height of the adhesive is easy. As shown in FIG. 7, the lower ends of the inclined portions 115 are provided at a position higher than half of the height of the element substrate 101.

According to the above-described embodiment, even if the relatively low-viscous sealing material 110 is used, it is possible to provide the liquid ejection head 100 in which only necessary electrically connected portions are sealed, without adding a separate member or a production process.

Furthermore, in order to securely protect the connecting portions between the inner leads 109 and the connecting terminals 107 of the element substrate 101, a sealing material 110 having a relatively higher viscosity than the preliminarily charged sealing material may be applied to the connecting portions between the inner lead and the connecting terminals 107 of the element substrate 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-002166 filed Jan. 7, 2011, which is hereby incorporated by reference herein in its entirety.

What is claimed is:

1. A method of producing a liquid ejection head, the method comprising:

preparing an element substrate including energy generating elements that generate energy for ejecting liquid and connecting terminals electrically connected to the energy generating elements, an electrical wiring member including lead wires electrically connected to the connecting terminals, and a support member configured to support the element substrate, the support member having a recess for accommodating the element substrate and a protrusion protruding inward from an inner surface of the recess;

providing adhesive on a bottom surface of the recess;

positioning the element substrate in the recess and pressing the adhesive to introduce a portion of the adhesive into a space between the protrusion and the element substrate; and sealing a connected portion of the connecting terminals and the lead wires with a sealing material, the sealing material being prevented from flowing by a portion of the adhesive filling the space between the protrusion and the element substrate.

2. The method according to claim 1, wherein the connecting terminals are provided at one end and the other end of the element substrate, and the protrusion faces a side surface of the element substrate extending in a direction perpendicular to the direction connecting the one end and the other end.

3. The method according to claim 2, wherein the element substrate has a supply port, including a through-hole, through which ink is supplied to the energy generating elements, and the protrusion is provided at a position closer to an end of the element substrate than an end of the supply port in the direction connecting the one end and the other end.

4. The method according to claim 1, wherein the adhesive is introduced into the space between the protrusion and the element substrate to a height higher than or equal to half of the height of the element substrate.

5. A liquid ejection head comprising:

an element substrate including energy generating elements that generate energy for ejecting liquid and connecting terminals that are electrically connected to the energy generating elements;

an electrical wiring member including lead wires electrically connected to the connecting terminals;

a support member having a recess for accommodating the element substrate and configured to support the element substrate via adhesive; and a sealing material configured to seal a connected portion of the connecting terminals and the lead wires;

wherein the support member has a protrusion protruding from a side surface of the recess toward a portion of the element substrate facing the side surface, at a position near the connected portion, and wherein a portion of the adhesive is provided in a space between the protrusion and the portion facing the side surface so as to be in contact with the sealing material.

6. The liquid ejection head according to claim 5, wherein the connecting terminals are provided at one end and the other end of the element substrate, and a portion facing the protrusion is provided on a side surface of the element substrate extending in a direction perpendicular to the direction connecting the one end and the other end.

7. The liquid ejection head according to claim 6, wherein the portion facing the protrusion is provided at one end and the other end of the side surface of the element substrate.

8. The liquid ejection head according to claim 7, wherein the element substrate has a supply port, including a through-hole, through which ink is supplied to the energy generating elements, and the portion facing the protrusion is provided at a position closer to an end of the element substrate than an end of the supply port in the direction connecting the one end and the other end.

9. The liquid ejection head according to claim 5, wherein the distance between the protrusion and the portion facing the protrusion is larger at the top surface than the bottom surface of the recess.

10. The liquid ejection head according to claim 5, wherein the adhesive is provided at the portion facing the protrusion to a height higher than or equal to half of the height of the element substrate.

* * * * *